United States Patent [19]

Lansmich

[11] 4,034,905

[45] July 12, 1977

[54] FLAT ADVANCEMENT OF RUNNING WEB BETWEEN GUIDE ROLLERS

[75] Inventor: Karl-Otto Lansmich, Dusseldorf, Germany

[73] Assignee: Jagenberg Werke AG, Dusseldorf, Germany

[21] Appl. No.: 545,659

[22] Filed: Jan. 30, 1975

[30] Foreign Application Priority Data

Feb. 19, 1974 Germany ..... 2407848

[51] Int. Cl.[2] ..... B65H 23/08

[52] U.S. Cl. ..... 226/195; 226/95

[58] Field of Search ..... 226/1, 7, 89, 91, 95, 226/39, 195, 196; 242/75.2

[56] References Cited

U.S. PATENT DOCUMENTS

| | | | |
|---|---|---|---|
| 3,174,669 | 3/1965 | Zernov | 226/195 X |
| 3,468,606 | 9/1969 | Wolf | 226/95 X |
| 3,472,439 | 10/1969 | Eastcott | 226/195 |
| 3,729,123 | 4/1973 | Lloyd | 226/195 X |
| 3,799,419 | 3/1974 | Herzhoff | 226/95 X |

*Primary Examiner*—Richard A. Schacher
*Attorney, Agent, or Firm*—Burgess, Dinklage & Sprung

[57] ABSTRACT

A method and apparatus for the flat advancement of one or more running webs of paper between two guide rollers and/or for combining two such webs, the apparatus comprising a pair of guide rollers between which a web is to be passed, a table having a guide surface positioned along the path of the web between the guide rollers, and an air removal body in tandem with the table to form a vacuum zone between the web and the surface thereby drawing the web toward the surface while the web moves therealong, the air removal body having a sharp edge directed against the direction of movement of the web. Advantageously the air removal body has a sharp edge positioned adjacent one of the guide rollers so as to form therewith a narrow gap through which the supply web is carried, the active surfaces of the air removal body and guide table lying in a common plane. A working cylinder may be pivotally connected to the air removal body to permit it to be lowered to enlarge the gap with the guide roller to facilitate threading up of the web.

5 Claims, 1 Drawing Figure

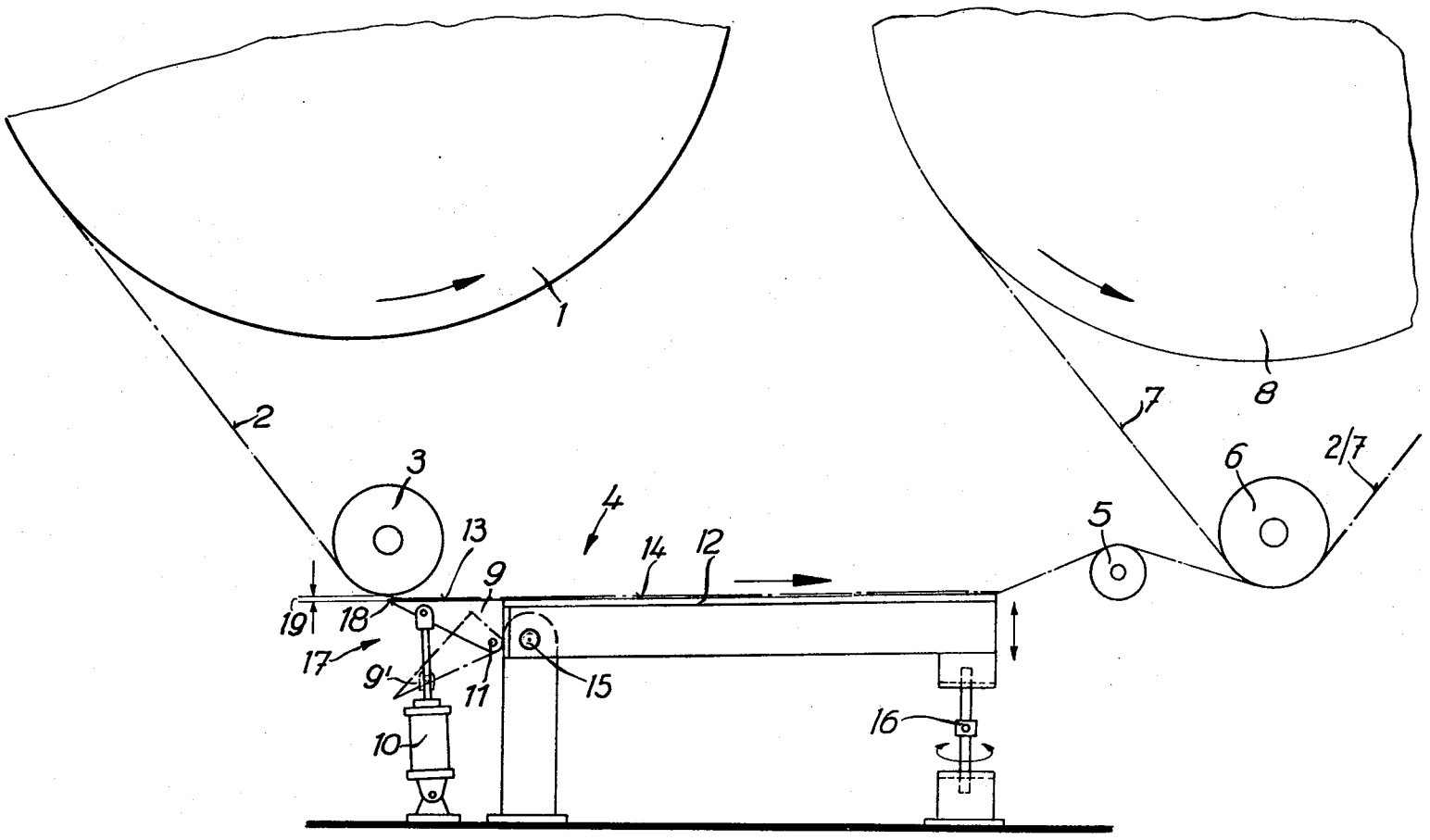
1
2
3
4
5
6
7
8
9
9'
10
11
12
13
14
15
16
17
18
19
2/7

FLAT ADVANCEMENT OF RUNNING WEB BETWEEN GUIDE ROLLERS

BACKGROUND

The invention relates to a method for the flat and level advancement of one or more supply webs of paper or the like which are freely suspended between two guide rollers in paper fabricating machines, and it additionally relates to an apparatus for the practice of the method.

In the production of a multi-layer web of paper or the like, as for example in the forming of a multi-layer web of tissue paper on a combination embossing and winding machine, it is necessary to form the web from several supply rolls at once, which means that, under certain circumstances, substantially horizontal lengths of material extend over different distances between the individual supply rolls and the machine. In this case, the webs of material guided in this manner tend, due to their elasticity, to undergo planar oscillations during their forward movement, obliging the machine operator to reduce the speed of the machine, because otherwise tearing and other such time-comsuming disturbances will be produced, due to the delicate nature of the material.

To avoid these disadvantageous trajectories, the web of material that causes the difficulty is passed around guide rollers for the purpose of reducing its unsupported length. Such means of guiding a web of material have the disadvantage that it is very difficult to thread in a new or torn end of material, because these guide rolls are usually disposed near the floor and hence often underneath the supply rolls. Furthermore, the usually great diameter of the supply rolls makes it impossible, without tools and personal aid, to take the fresh end of a web from a remote supply roll and pass it underneath the supply rolls closest to the machine when the latter are mounted with relatively little clearance above the floor.

THE INVENTION

The invention is addressed to the problem, on the one hand, of facilitating the threading of a web of material from the supply rolls remotest from the machine and, on the other hand, of achieving a steady and flutter-free web transport during operation.

This problem is solved in accordance with the invention by the fact that, for the combining and flat advancement of one or more webs of paper or the like introduced into paper fabricating machines, the ambient air adjacent the web is drawn away from at least one side of this web such that a partial vacuum is produced on a portion of the paper feed trajectory. To draw away the ambient air an apparatus is provided in which an air removal body equipped with a sharp edge is associated with the web of material, the sharp edge being oriented against the direction of movement of the web and almost touching the web. The system is furthermore so arranged that the sharp edge of the air removal body forms with an adjacent guide roller a gap through which the web of material is carried. Furthermore, a guide table follows the air removal body such that their active surfaces form a common plane. In further development of the apparatus the air removal body is mounted for pivoting about a pivot point by means of a hydraulic jack.

The advantages achieved by the invention consist especially in the fact that it has become possible, by means of the guide table, on the one hand to guide a supply web consisting of tissue paper or the like, for example, in a flutter-free manner over a relatively long distance between two guide rollers, and, on the other hand, to simplify substantially the introduction of the individual web ends. From this, additional advantages result, which consist in the fact that, on account of the smooth web transport, the machine speed can be increased, and that the use of the guide table as an insertion aid reduces the idle time of the machine as well as the use of personnel for assistance.

An exemplifying embodiment is represented in the drawing and is further described hereinafter.

A supply web 2 drawn from a supply roll 1 is first turned by a guide roller 3 into the horizontal plane and advanced in its continued forward movement over a guide system 4. As it continues to advance, the supply web 2 is picked up by a guide roller 5 and delivered to another guide roller 6. In the area of contact with this roller 6, the supply web 2 is combined with another supply web 7 which is drawn from a supply roll 8 that is nearest to the fabricating machine, which is not represented. After passing the guide roller 6 the two supply webs 2 and 7 are delivered together to the fabricating machine.

The construction and operation of the guide system 4 is as follows: First, the guide system 4 consists of an air removal body 9 which is pivoted about a pivot point 11 by means of a hydraulic jack 10. This air removal body is adjoined in the direction of movement of supply web 2 by a guide table 12 such that the active surfaces 13 and 14 of the air removal body 9 and guide table 12, respectively, form one plane.

In the area of the air removal body 9 the guide table 12 is mounted for pivoting about an axis 15, the latter extending parallel to the supply web 2 and perpendicular to its direction of movement.

At the end of guide table 12 opposite this axis 15 the guide table has an adjusting screw 16 with one left-hand and one right-hand thread.

When the supply web 2 is inserted, first the air removal body 9 is pivoted into position 9' so as to provide a sufficiently large insertion opening 17. The end of the web can then conveniently be pushed through the insertion opening 17 onto the guide table 12, and can then be picked up on the other side of the supply roll 1 or guide roller 3, as the case may be, and can be delivered to the additional rollers 5 and 6.

Upon the beginning of the operation of the machine, when the air removal body has been pivoted back into its working position and the supply webs 2 and 7 have been simultaneously pulled forward, the ambient air is removed from the underside of the supply web 2 by means of the sharp edge 18 of the air removal body 9, so that the supply web 2, as it continues to advance over the guide table 12, will apply itself uniformly, due to the vacuum on the bottom, against the slick surface 14 of guide table 12. The supply web 2 is thus carried without vibration and without any undesirable flutter over a relatively long distance, so that the speed of the machine can be substantially increased.

In order to be able to further modify the air removal effect produced by the air removal body 9, the adjusting screw 16 can be operated to produce a modification of the gap 19.

When more than two webs are fabricated simultaneously, it is easily possible, for the achievement of a general, flutter-free web feed, to dispose the above-described combination introduction and guidance system between every two supply rolls.

It will be appreciated that the instant specification and examples are set forth by way of illustration and not limitation, and that various modifications and changes may be made without departing from the spirit and scope of the present invention.

What is claimed is:

1. An apparatus for the flat advancement of a tissue paper web, comprising a pair of guide rollers between which a web is to be passed, a table having a guide surface positioned along the path of the web between the guide rollers, the guide rollers being spaced from one another a sufficient distance so as normally to result in fluttering of the web in passage therebetween over the table, and an air removal body in tandem with the table to form a vacuum zone between the web and the surface thereby drawing the web toward the surface while the web moves therealong, the air removal body having a sharp edge directed against the direction of the movement of the web, whereby there is minimized the fluttering which would otherwise occur.

2. An apparatus according to claim 1, wherein the air removal body is succeeded by the guide table and their active surfaces lie in a common plane.

3. An apparatus according to claim 1, wherein the sharp edge of the air removal body is positioned adjacent one of the guide rollers so as to form therewith a norrow gap through which the web is carried.

4. An apparatus according to claim 3, including a working cylinder pivotally connected to the air removal body, actuation of the cylinder causing the air removal body to be displaced relative to the one guide roller so as to enlarge the gap to facilitate threading up of the web.

5. An apparatus according to claim 4, wherein the air removal body is succeeded by the guide table and their active surfaces lie in a common plane.

* * * * *